US005460469A

United States Patent [19]

Young

[11] Patent Number: 5,460,469

[45] Date of Patent: Oct. 24, 1995

[54] PANEL APPARATUS

[76] Inventor: Roland O. Young, R.R. #1, Box 138, Grand Forks, N. Dak. 58201

[21] Appl. No.: 315,707

[22] Filed: Sep. 30, 1994

[51] Int. Cl.[6] ..... B66F 9/00

[52] U.S. Cl. ..... 414/11; 254/4 C; 254/5 C; 414/595

[58] Field of Search ..... 254/4 C, 4 R, 254/5 C, 5 R; 414/11, 595

[56] References Cited

U.S. PATENT DOCUMENTS

| | | | |
|---|---|---|---|
| 2,815,132 | 12/1957 | Stone | 414/11 |
| 3,305,219 | 2/1967 | Rhodes | 414/11 |
| 4,027,802 | 6/1977 | Reynolds | 414/11 |
| 5,078,364 | 1/1992 | Harrell | 254/4 R X |

FOREIGN PATENT DOCUMENTS

| | | | |
|---|---|---|---|
| 1190527 | 10/1959 | France | 254/4 C |

*Primary Examiner*—Michael S. Huppert
*Assistant Examiner*—Janice L. Krizek
*Attorney, Agent, or Firm*—Robert E. Kleve

[57] ABSTRACT

The invention comprises a panel lifting apparatus having a U shaped horizontal frame with rollers mounted along the bottom for transporting the frame from place to place. A pair of inclined channels are mounted in spaced relation along the apex of the frame. A pair of hooks having rod like extensions are each mounted on a frame having rollers for rolling along the inclined channels to roll the hooks upward and downward along the inclined channels. A crank and drum are rotatably mounted on one of said channels. A cable has its ends attached to the pair of hooks and an intermediate portion extending through the drum whereby rotation of the drum by the crank in one direction causes the cables to wind in opposite directions on the same drum to wind the ends of the cables upward simultaneously and thereby draw the hooks upward on the channels simultaneously. The channels extend sufficiently downward to be adjacent the frame rollers and the ground that the hooks may be lowered by the crank to immediate adjacency to the ground and are adapted to receive a drywall panel thereon adjacent the ground. The hooks may lift the panel up to a height where they may be transferred onto a panel lifter having an extended height capability.

2 Claims, 2 Drawing Sheets

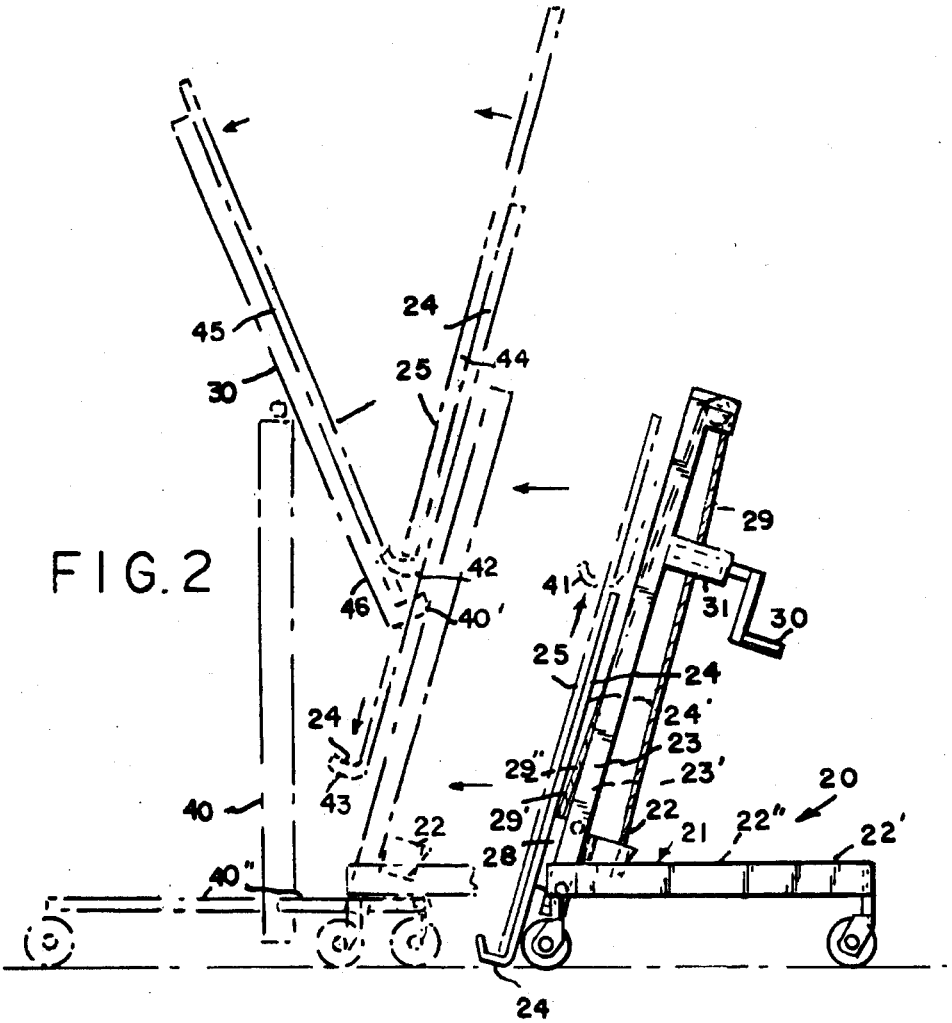
FIG. 2
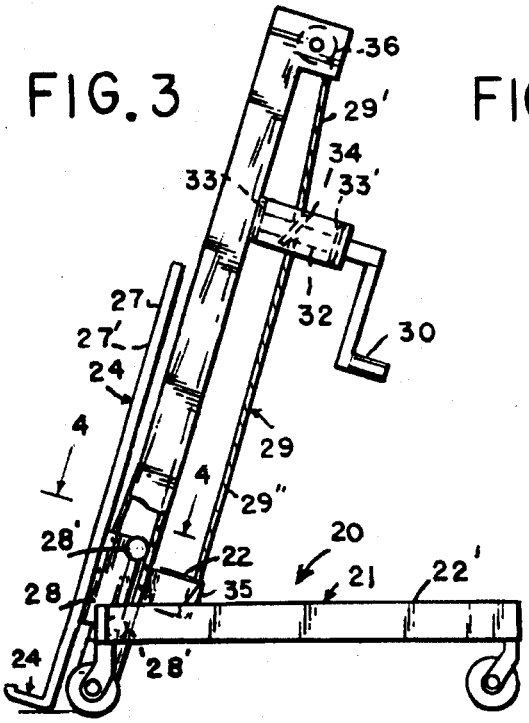
FIG. 3
FIG. 4
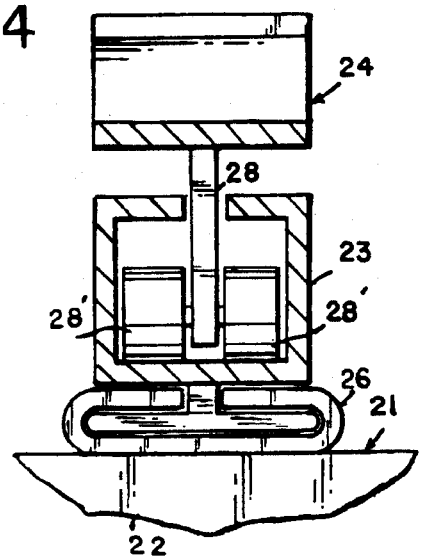

PANEL APPARATUS

This invention relates to panel transportation and or panel handling apparatus.

It is an object of the invention to provide a novel panel handling apparatus which can be easily operated to receive a drywall panel when the panel is immediately adjacent the floor and elevate the panel to a height where it can be readily transferred to another drywall lift having a greater height lifting capability.

It is another object of the invention to provide a novel panel handing apparatus which enables a drywall panel to be easily transported from one location to another.

It is another object of the invention to provide a novel panel lifting apparatus which has lifting lugs that can be lowered to the ground to receive and elevate a drywall panel.

Further objects and advantages of the invention will become apparent as the description proceeds and when taken in conjunction with the accompanying drawings wherein:

BRIEF DESCRIPTION OF THE DRAWING

FIG. 2 is a side elevational view of the panel loading and lift invention shown in solid lines receiving the drywall panel and shown in phantom lines having elevated the drywall panel and with the drywall panel shown transferred onto a panel lift having further elevating capability.

FIG. 3 is an enlarged side elevational view of the panel handling invention.

FIG. 4 is a cross sectional view taken along line 4—4 of FIG. 3.

BRIEF DESCRIPTION OF PREFERRED EMBODIMENT

Figure 1:
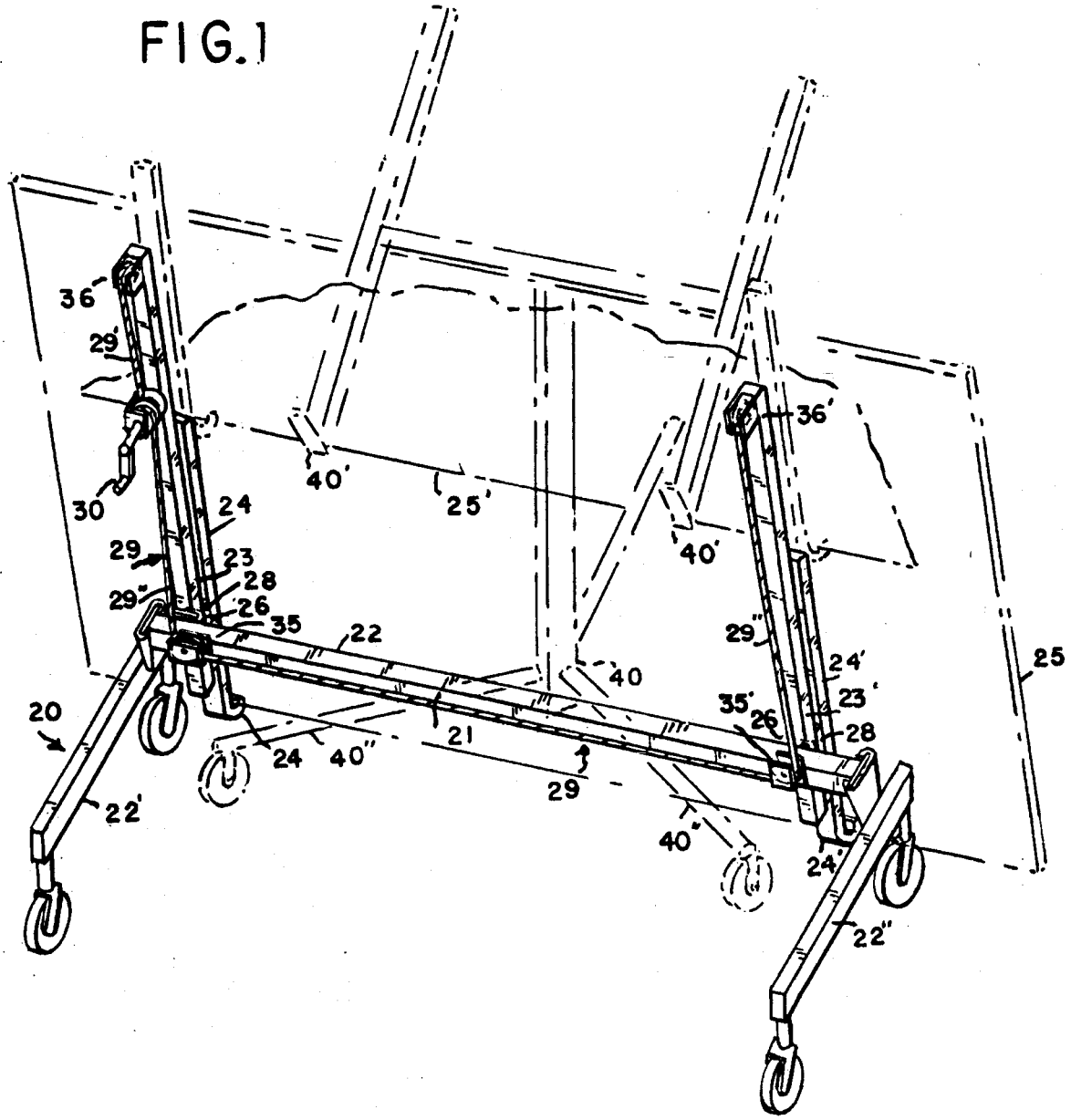
FIG. 1 is a perspective view of the panel loading and lifting apparatus, shown in solid lines with the lifting lugs upon the ground and a drywall panel mounted thereon, with the lifting lugs and drywall panel shown in fragmentary phantom lines after the lugs and panel have been lifted, and with a drywall lifter shown in phantom lines to receive the panel and lift it further to more extended heights.

Briefly stated, the invention comprises a panel loading and handling apparatus having a U shaped, horizontal frame with rollers mounted along the bottom. A pair of upward inclined channels are mounted to the apex of the U shaped frame. A pair of rods with hooks at their bottoms are mounted on rollers in the channels to roll up and down the channels. A cable winding apparatus is provided on one of the channels for winding a cable attached to the rods to raise the rods with the hooks at their bottom upward, simultaneously, along the channels to raise a drywall panel mounted thereon. The U-shaped frame is adapted to be mounted on the rollers high enough off the ground to enable the base legs of a drywall panel lifter to roll underneath the frame to close proximity to the apparatus, and the hooks are adapted to be raised high enough in relation to lifting means on the lifter; so that the panel can be lifted by the hooks and, by the apparatus being in close proximity to the lifter having extended height lifting capability, can be transferred onto the lifting means of the lifter and lifted by the lifting means to an extended height.

Referring more particularly to the drawing, in FIG. 1, the panel handling and lifting apparatus 20 is illustrated having a U shaped frame 21 with a cross frame member 22 across the apex portion and a pair of parallel leg members 22' and 22" extending laterally from the cross piece with the leg members in parallel relation to one another. A pair of inclined channel members 23 and 23' extend upward, at an angle from the cross piece; and are detachably fixed to the cross piece by a tongue and groove connection 26. A pair of elevating hooks 24 and 24' have straight rod extensions 27 and 27' and a roller plate 28 is fixed on each rod with rollers 28' rotatably mounted on the roller plates to roll along the inclined channels 23 and 23', to guide the hooks upward and downward along the channels 23 and 23'.

A cable 29 has its one end 29' attached to roller plate 28 on rod 27 and its other end 29" attached to the roller plate 28 on rod 27'. A crank 30 is rotatably mounted to a U-shaped bracket 31 and the U shaped bracket 31 is fixed to the rear face of the channel 23.

The crank 30 has a center drum 32 fixed to the inner end of the crank with end flanges 33 and 33' and a center annular flange 34 which extends annularly about the center of the drum. The cable 29 passes through a hole in the center of the drum 32. Prior to any winding of the cable onto the drum, the upper portion 29' of the cable extends into the hole in the drum to the left of the center flange 34, when viewed from FIG. 3, and the lower portion 29" of the cable extends to the right of the center flange 34, which then acts to cause the cable to the left to wind more evenly onto the drum portion to the left of the flange as to the upper portion of the cable, and acts to cause the lower cable portion 29" to wind more evenly onto the drum to the right of the flange 34, when viewed from FIG. 3, when the crank is wound clockwise, when viewed from FIG. 1.

A pair of pulleys 35 and 35' are rotatably mounted to the lower cross piece member 22, and a pair of pulleys 36 and 36' are rotatably mounted to the upper ends of the inclined channels 23 and 23' and act to guide the cable portions 29' and 29" onto the left and right portions of the drum 32 when winding the cable onto the drum by a clockwise rotation of the crank 30, when viewed from FIG. 1. This causes the ends of the cable 29' and 29" to act to draw both hooks 24 and 24' upward along the channels 23 and 23' by the rollers rolling along the channels so that both hooks move up and down simultaneously with one another.

Operation:

The drywall panel handling apparatus 20 will be operated as follows:

A conventional drywall panel 25, that is to be installed at elevations that require the panel be lifted by a conventional drywall panel lifter 40 such as shown and designated by numeral 40 in phantom lines in FIGS. 1 and 2 and which customarily has two telescoping sections that can elevate the panel 25 higher than the invention 20, will initially be placed on the hooks 24 and 24' of the apparatus 20 when the two hooks have been lowered to the ground as shown in solid lines in FIGS. 2 and 3. When the hooks have been lowered to the ground, placing the drywall panels 25 on the hooks only requires elevating the panel or panels 25 several inches off the ground and then sliding the panels 25 horizontally onto the hooks.

Thereafter, the crank 30 of the apparatus will be rotated to lift the hooks 24 and 24' from their position shown in solid lines on the ground upward to their position shown in phantom lines designated by numeral 41 for example. This raises the lower edge 25' of the drywall panel to a height higher than the hooks 40' on the lifter.

Thereafter, the invention 20 will be rolled on the rollers toward the lifter 40 to its position shown in phantom lines 42. Its cross piece member 22, being higher than the three horizontal legs 40" of the lifter 40, can travel over the tops of the legs 40" of the lifter 40 to place the invention 20 and the drywall panel 25, thereon, close to the lifter 40, such as shown in phantom lines and designated by numeral 42, with the lower edges 25' of the panel 25 just over the hooks 40' of the drywall lifter 40.

Whereupon, the crank 30 will be rotated in an opposite direction to lower the hooks 24 and 24' to their position shown in phantom lines and designated by numeral 43 to thereby lower the lower edge 25' of the panel 25 onto the hooks 40' of the lifter. Once the lower edge of the panel 25 engages the hooks 40' of the lifter, the drywall panel 25 will stop its downward movement. However, the operator will continue rotating the crank to continue lowering the hooks 24 and 24' to place them well below the edges of the panel 25 such as shown in phantom lines 43. Whereupon, the panel 25 will be pivoted from its position shown in phantom lines 44 to its position shown in phantom lines 45, so that the panel 25 will be resting entirely on the drywall lifter 40, with its lower edge resting on the hooks 40' of the lifter 40. Thereafter, the panel support 46 of the lifter 40 may be pivoted horizontally and the lifter rolled to its desired position for panel elevation by the lifter; and the panel elevated by the lifter 40 for installation of the panel 25, for example, on a ceiling.

The panel handling invention 20 may also be used to simply transport drywall panels along the ground from one location to another, as the drywall panel only needs to be lifted a few inches off the ground and placed on the handler invention; and then the handler and the drywall thereon may be rolled along the ground or floor to a desired location. This eliminates the need manually to carry a drywall panel from one location to another.

Thus, it will be seen that a novel drywall panel lifter and transport device has been provided for lifting drywall panels on to lifters having extended height elevation capability and for transporting drywall panels from one location to another.

It will be obvious that various changes and departures may be made to the invention without departing from the spirit and scope thereof; and accordingly, it is not intended that the invention be limited to that specifically described in the specification or as illustrated in the drawings but only as set forth in the appended claims wherein:

What is claimed is:

1. A panel ground lifting apparatus adapted to lift panels from off the ground onto a panel lift having a further extending panel lifting capacity and wherein said panel lift has horizontal base supporting legs and a center column having a top with a panel support at the top, said apparatus comprising a horizontal base support having a horizontal member spaced above the ground sufficiently to pass freely over the base supporting legs of said panel lift to enable the apparatus to be positioned in close proximity to the lift, said base support having wheels mounted thereon, a pair of inclined channels mounted in spaced relation on the horizontal support, hook means having a carriage mounted in said channels and adapted to roll upward and downward in said channels to rotatably support said hooks, cable means connecting said hooks together to raise and lower said hooks in unision, means to wind and unwind said cable means, said hooks being adapted to be lowered in said channels to the ground whereby a dry wall panel may be slid onto the hooks from the ground and the apparatus may be rolled on said wheels into close proximity to said lift and said winding means may wind said cable means to raise said hooks and thereby raise said panel up to the height of said panel support on said lift and said panel may be transferred onto said panel support on said lift and said lift may raise said panel support and panel to a further extended height.

2. A panel ground lifting apparatus adapted to lift panels from off the ground onto a panel lift having a further extending panel lift capacity and wherein said panel lift has horizontal base supporting legs with a center column having a top with a panel support at the top, said apparatus comprising a horizontal base support with a horizontal member spaced above the ground sufficiently to pass freely over the base supporting legs of said panel lift to enable the apparatus to be positioned in close proximity to the lift, said horizontal base support having wheels mounted in spaced relation on the horizontal base support, a pair of elongated inclined upwardly extending frame members mounted in spaced relation on the horizontal base support, hook means mounted to said inclined upwardly extending frame members and adapted to move upward and downward along the frame members, cable means connecting said hooks together to raise and lower said hooks in unision, means to wind and unwind said cable means, said hooks being adapted to be lowered to the ground whereby a dry wall panel may be slid onto the hooks from the ground and the apparatus may be rolled on said wheels into close proximity to said lift and said winding means may wind said cable means to raise said hooks and thereby raise said panel up to the height of said panel support on said lift and said panel may be transferred onto said panel support on said lift and said lift may raise said panel support and panel to a further extended height.

* * * * *